United States Patent [19]

Kawashima et al.

[11] Patent Number: 4,543,869

[45] Date of Patent: Oct. 1, 1985

[54] ELECTRONIC MUSICAL INSTRUMENT PRODUCING CHORD TONES UTILIZING CHANNEL ASSIGNMENT

[75] Inventors: Susumu Kawashima, Hamamatsu; Shigeru Yamada, Hamakita, both of Japan

[73] Assignee: Nippon Gakki Seizo Kabushiki Kaisha, Hamamatsu, Japan

[21] Appl. No.: 591,424

[22] Filed: Mar. 20, 1984

[30] Foreign Application Priority Data

Mar. 31, 1983 [JP] Japan ..... 58-056630

[51] Int. Cl.[4] ..... G10H 1/38; G10H 7/00

[52] U.S. Cl. ..... 84/1.01; 84/1.03; 84/DIG. 22

[58] Field of Search ..... 84/1.01, 1.03, 1.17, 84/1.24, DIG. 22

[56] References Cited

U.S. PATENT DOCUMENTS 4,351,214 9/1982 Suzuki et al. ..... 84/1.03

4,429,606 2/1984 Aoki ..... 84/1.17

*Primary Examiner*—Stanley J. Witkowski

*Attorney, Agent, or Firm*—Spensley Horn Jubas & Lubitz

[57] ABSTRACT

An electronic musical instrument is of a type in which tones are produced by a limited number of tone production channels which are efficiently used for a large number of tones utilizing channel assignment technology. A plurality of tones to constitute a chord are normally produced simultaneously by using plural channels, but when a duet mode is selected to automatically add a duet note to a melody note, the chord constituent tones are produced in succession as a broken chord utilizing only a single channel, thus leaving another channel available for production of the duet note. This eliminates the need to provide an additional tone production channel for the duet note.

2 Claims, 2 Drawing Figures

ELECTRONIC MUSICAL INSTRUMENT PRODUCING CHORD TONES UTILIZING CHANNEL ASSIGNMENT

BACKGROUND OF THE INVENTION

1. Field of the Invention

The present invention relates to an electronic musical instrument having a plurality of musical tone production channels capable of producing chord tones and add-note tones.

2. Description of the Prior Art

Those electronic musical instruments placed on the market recently are arranged so that the key data representative of the keys depressed on the keyboard and the key data generated in the musical instrument for the purpose of automatic accompaniment are assigned appropriately to a plurality of musical tone production channels which are provided in the instrument in a number far smaller than the total number of the keys provided on the keyboard, and that a plurality of musical tones are produced at the same time. In such an arrangement, these plurality of tone production channels are alloted for the formation of melody tones, chord tones, bass tones and other automatic accompaniment tones, respectively. In order to simplify the circuitry and to thereby reduce the manufacturing cost of the musical instrument, however, the number of these channels preferably is the smaller the better.

SUMMARY OF THE INVENTION

It is, therefore, an object of the present invention to provide an improved electronic musical instrument arranged so that various kinds of musical tones can be generated with a small number of tone production channels.

The electronic musical instrument constructed to attain the above-mentioned object features the arrangement that in the mode of performance to generate add-note tones for the key-operated melody tones as in the case of a duet performance, a plurality of tones for the accompaniment such as chord tones which are normally to be sounded simultaneously are altered to successive sounding (as a broken chord). More specifically, in case the add-note mode (e.g. duet mode) is selected, a key data for an add-note is assigned to one of the plurality of tone production channels which have been allotted for the formation of a plurality of tones which are to be produced simultaneously, to thereby cause this channel to produce the add-note tone, and concurrently therewith, broken chord note key data are assigned to another channel to cause the latter to produce broken chord tones whereby eliminating the need to provide the instrument with an additional special tone production channel exclusively for the add-note tones.

DETAILED DESCRIPTION OF THE PREFERRED EMBODIMENT

Figure 1A:
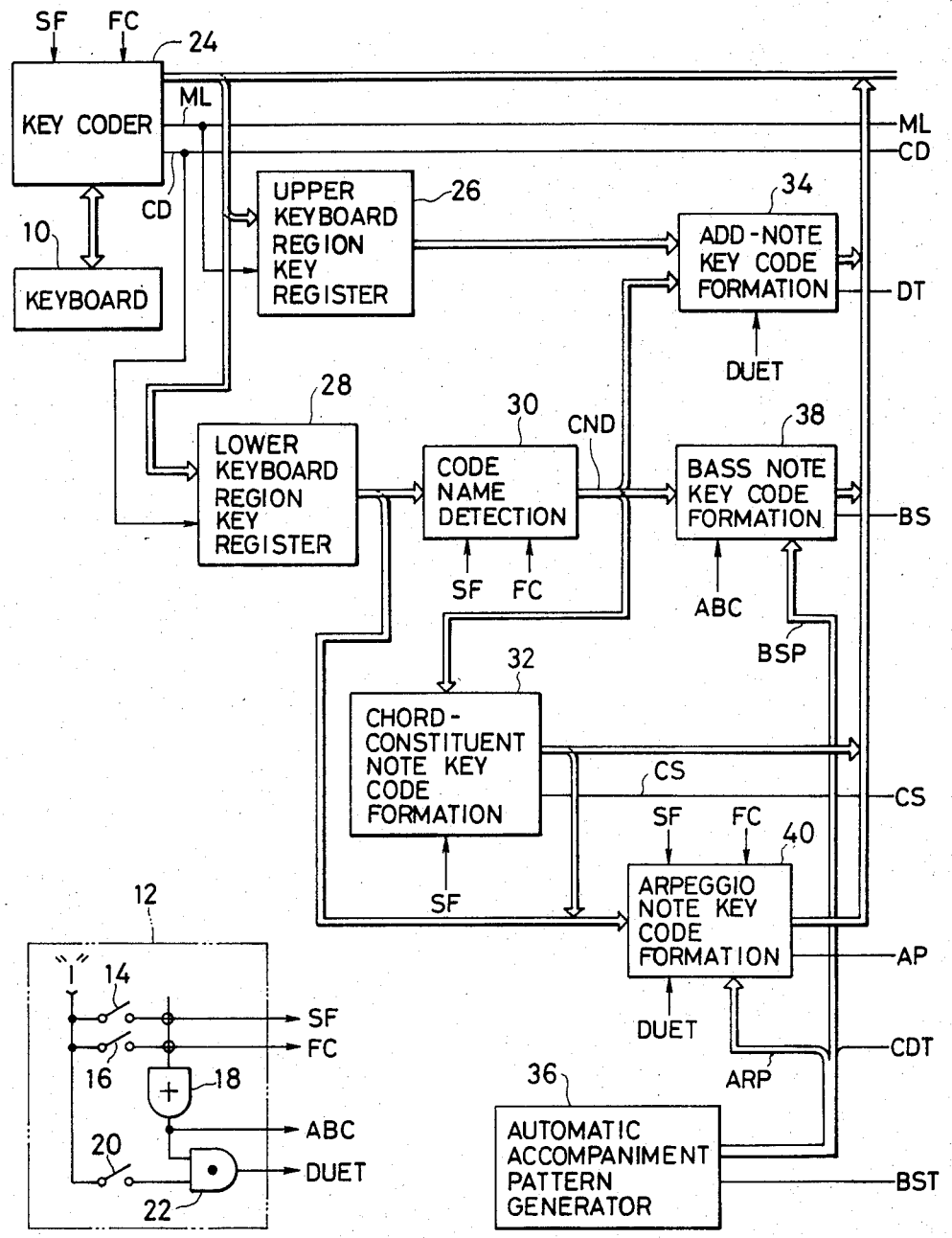
FIGS. 1A′ and 1B′, as a combination, represent a block diagram showing the circuit arrangement of an electronic musical instrument according to an embodiment of the present invention.
Figure 1B:
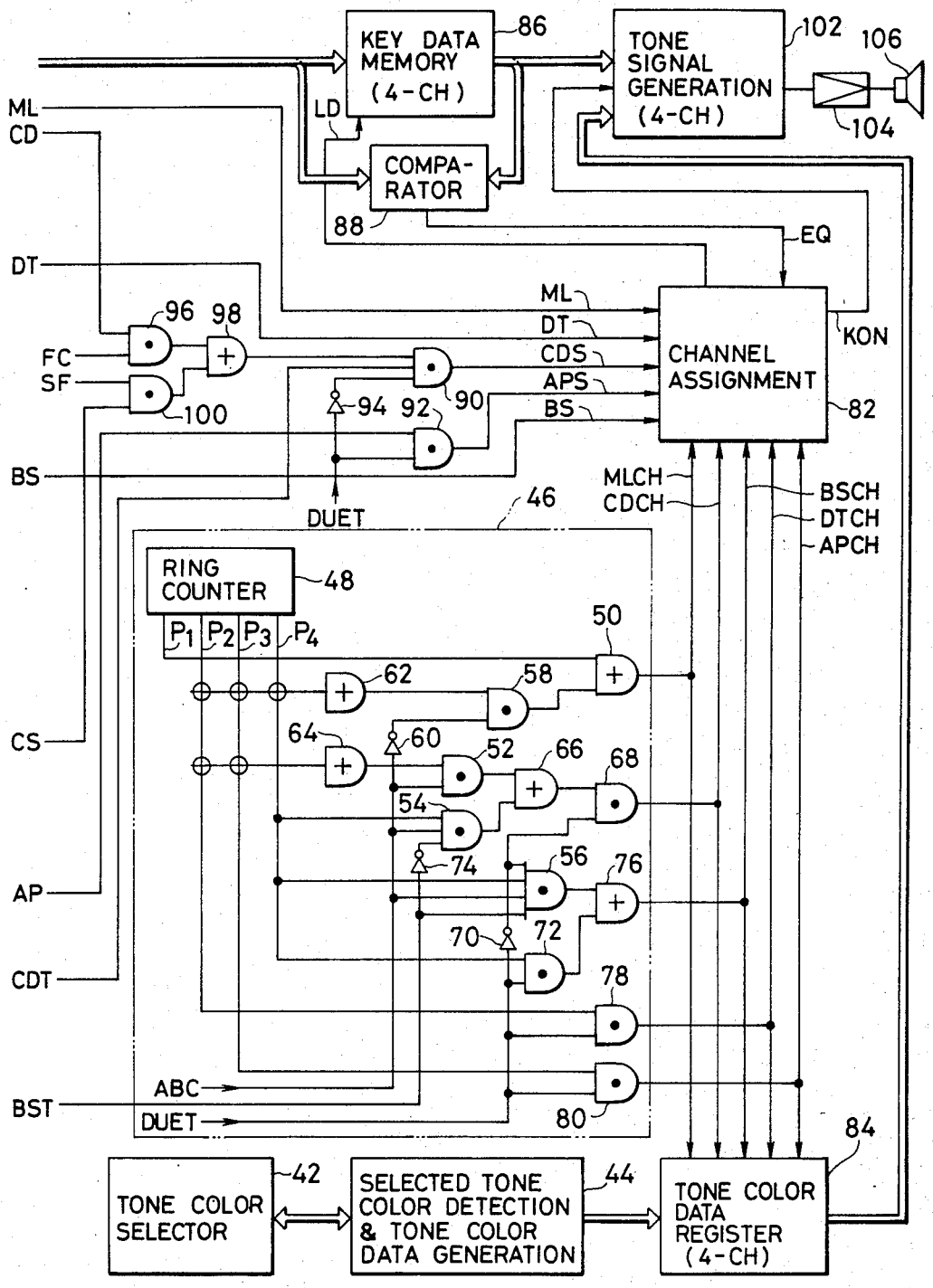

The accompanying drawing is a block diagram showing the circuit arrangement of an embodiment of the present invention. The detail circuit arrangement as well as the operation thereof are described below.

A keyboard circuitry 10 comprises an upper keyboard region and a lower keyboard region (an upper keyboard and a lower keyboard in the case of a double or more manual instrument, or an upper fraction and a lower fraction of a same keyboard in the case of a single manual instrument), and a number of key switches corresponding to each of a number of keys provided in these respective keyboard regions.

In a mode setting circuit 12, let us assume that a switch 14 is turned on. Whereupon, a single finger mode signal SF="1" is generated. The turning-on of a switch 16 causes the generation of a fingered chord mode signal FC="1". When either the switch 14 or the switch 16 is turned on, there is generated an automatic bass chord mode signal ABC through an OR gate 18. When a switch 20 is turned on when said mode signal ABC="1", a duet mode signal DUET="1" is generated through an AND gate 22.

In the normal mode wherein the mode signal ABC is "0", it is possible to perform a melody playing on the entire upper and lower keyboard regions of the keyboard circuitry 10. Also, in the automatic bass chord mode or in the duet mode in both of which the mode signal ABC is "1", a melody playing can be performed in the upper keyboard region, whereas an accompaniment play such as using chords can be made in the lower keyboard region in the keyboard circuitry 10.

A key coder 24 is arranged to be operative so that it scans sequentially and repetitively the key switches for all the keys of both the upper and lower keyboard regions in the keyboard circuitry 10 to detect the depressed keys. In case the mode signal SF or FC is "1" (i.e. either the automatic bass chord mode or the duet mode), the key coder generates key code data representative of the melody keys depressed in the upper keybord region together with a data category signal ML="1", and concurrently it generates key code data corresponding to the accompaniment keys depressed in the lower keyboard region together with a data category signal CD="1". In case the mode signals SF and FC are both "0" (i.e. the normal mode), it generates key code data representing the melody keys depressed in both the upper and lower keyboard regions and also generates a data category signal ML="1". It should be understood here that the data category signals ML and CD indicate that the key code data are melody key code data and accompaniment key code data, respectively.

An upper keyboard region key register 26 is loaded with melody key code data representing the keys depressed in the upper keyboard region in accordance with the data category signal ML="1", and it stores said data temporarily. Also, a lower keyboard region key register 28 is loaded with accompaniment key code data representing the keys depressed in the lower keyboard region in accordance with the data category signal CD="1", and it stores the data temporarily.

A chord name detecting circuit 30 is arranged so that it detects a chord name (identified by a root note and a chord type) based on the accompaniment key code data supplied from the lower keyboard region key register 28, and that it generates chord name data CND (including a root note data and a chord type data). The chord name detecting operation is to identify the root note and the type of the chord, and this identifying or judging manner would vary depending on which one of the mode signals SF and FC is "1".

More specifically, in case the mode signal SF="1", it should be noted that, if the number of the depressed key is just 1 (one), this circuit 30 will judge that this depressed key represents the root note of the chord and the type of the chord is major. If, on the other hand, a plurality of keys have been depressed simultaneously, the circuit 30 will determine that the key having the highest pitch among the plurality of depressed keys represents the root note of the chord, and concurrently therewith it determines that the type of the chord is minor, seventh and so forth in accordance with the number of the other depressed keys or with the kind, such as a natural key or a sharp key, of the depressed keys. Also, in case of the mode signal FC="1", the circuit 30 will determine the root note and the type of the chord from a plurality of (usually three) key code data resulting from the depression of the chord keys in the lower keyboard region.

A chord-constituent note key code forming circuit 32 is arranged to form, in accordance with the chord name data CND when the mode signal SF="1", a plurality of key code data representative of the chord-constituent notes (e.g. C, E and G in the case of C major triad chord) which are to be sounded. These chord-constituent note key code data are delivered out together with the data category signal CS="1" at a predetermined timing at each completion of one scanning of the entire keys by the key coder 24 (i.e. at each end of one scanning cycle). It should be noted here that the data category signal CS is indicative of the fact that the delivered-out key code data are the chord-constituent note key code data.

An add-note key code forming circuit 34 is designed to form key code data corresponding to the add-note which is to be sounded together with the melody note, by giving reference to the harmony note table in accordance with the melody key code data supplied from the upper keyboard region key register 26 and with the chord name data CND supplied from the chord name detecting circuit 30, in case the mode signal DUET="1". The add-note key code data thus formed is delivered out along with the data category signal DT="1" at a predetermined timing at each end of one scanning cycle of the key coder 24. It should be noted here that the data category signal DT is indicative of the fact that the delivered-out key code data represent the add-note key code data.

An automatic accompaniment pattern generator 36 is so arranged as to generate arpeggio note decisive data ARP, chord timing signal CDT, bass note decisive data BSP and bass timing signal BST in accordance with a predetermined automatic accompaniment pattern. Respective arpeggio note decisive data ARP are adapted to indicate the interval degrees of the arpeggio tones which are to be sounded, with respect to the root note of the chord and also respective bass note decisive data are adapted to indicate the interval degrees of the bass tones which are to be sounded with respect to the root note of the chord. Also, the chord timing signal CDT and the bass timing signal BST are arranged, usually, to instruct the timings of their sounding which do not coincide with each other.

A bass note key code forming circuit 38 is designed to form key code data representing the bass notes which are to be sounded, in accordance with the chord name data CND and the bass note decisive data BSP in case the mode signal ABC="1". The bass note key code data thus formed are delivered out along with the data category signal BS="1" at a predetermined timing for each completion of one scanning cycle of the key coder 24. It should be noted here that the data category signal BS indicates the the delivered-out key code data represent the bass note key code data.

An arpeggio note key code forming circuit 40 is designed to form arpeggio note key code data representing the plural number of notes which are to be sounded in the form of broken chord notes when the mode signal DUET="1". This circuit is arranged so that it will form arpeggio note key code data based on the accompaniment note key code data (chord-constituent note key code data) supplied from the lower keyboard region key register 28 and based on the arpeggio note decisive data ARP in case the mode signal FC="1", and will form arpeggio note key code data based on the chord-constituent note key code data supplied from the chord-constituent note key code forming circuit 32 and also on the arpeggio note decisive data ARP in case the mode signal SF="1". And, the plural number of arpeggio note key code data thus formed are delivered out successively along with the data category signal AP="1" at predetermined timings after each completion of one scanning cycle of the key coder 24. It should be noted here that the data category signal AP indicates that the delivered-out key code data are indicative of the arpeggio note key code data.

A tone color selector 42 contains, on the panel surface of the body of the musical instrument, a number of manipulation buttons or knobs for tone color selection for various kinds of musical tones such as for melody, chord, bass, arpeggio and so forth. A selected tone color detection and tone color data generation circuit 44 is arranged to detect, by scanning, the tone color selected in the tone selector 42 and to generate tone color data for respective kinds of musical tones.

A channel assignment controlling circuit 46 has a ring counter 48 which generates sequential pulses $P_1 \sim P_4$ in correspondence to the first to the fourth channel timings. The operation speed of this counter 48 is set quick (e.g. 1 micro-second per pulse) so as to twice repeat the cycle of generation of the sequential pulses $P_1 \sim P_4$ during the duration of one key code data.

The sequential pulses $P_1 \sim P_4$ delivered from the ring counter 48 are used for the formation of: a channel assignment timing signal MLCH for a melody tone, a channel assignment signal CDCH for a chord tone, a channel assignment timing signal BSCH for a bass tone, a channel assignment timing signal DTCH for an add-note tone, and a channel assignment timing signal APCH for an arpeggio tone, in accordance with the mode signals ABC and DUET, and with the bass timing signal BST. Which one of these signals MLCH, CDCH, BSCH, DTCH and APCH is formed from these respective pulses in accordance with the state of the signals ABC, DUET and BST is as shown in the following table.

TABLE 1

| | | $P_1$ | $P_2$ | $P_3$ | $P_4$ |
|---|---|---|---|---|---|
| ABC = "0" | | MLCH | MLCH | MLCH | MLCH |
| ABC = "1" | BST = "0" | MLCH | CDCH | CDCH | CDCH |
| DUET = "0" | BST = "1" | MLCH | CDCH | CDCH | BSCH |
| ABC = "1" DUET = "1" | | MLCH | DTCH | APCH | BSCH |

More specifically, in the normal mode wherein the mode signal ABC="0", a pulse $P_1$ is delivered out as the channel assignment timing signal MLCH for a melody tone, via an OR gate 50. Since gates 52, 54 and 56 are then disabled, whereas an AND gate 58 is enabled by the output signal "1" of an inverter 60, the sequential pulses $P_1 \sim P_4$ are delivered out as the signal MLCH via an OR gate 62, the AND gate 58 and the OR gate 50.

Also, in case of the automatic bass chord mode wherein the mode signal ABC="1" and the mode signal DUET="0", a pulse $P_1$ is delivered out to serve as the signal MLCH as in the above-mentioned instance. And, since the AND gate 52 is enabled, whereas the AND gate 58 is disabled by the output signal "0" of the inverter 60, the sequential pulses $P_2$ and $P_3$ are delivered out to an AND gate 68 via an OR gate 64, the AND gate 52 and an OR gate 66. At such an instance, the AND gate 68 is being enabled by the output signal "1" of an inverter 70, and therefore, pulses $P_2$ and $P_3$ are delivered out to serve as the channel assignment timing signals CDCH for chord tones, via the AND gate 68. In this instance, if the bass timing signal BST, because of its being "0", does not instruct the sounding of a bass tone, it will be understood that, because the AND gate 56 is disabled while the AND gate 54 is enabled by the output signal "1" of an inverter 74, a pulse $P_4$ is delivered out to serve as the signal CDCH via the AND gate 64, the OR gate 66 and the AND gate 68. In constrast thereto, when the bass timing signal BST, being "1", instructs the sounding of a bass tone, this causes the AND gate 56 to be enabled and the AND gate 53 to be disabled by the output signal "0" of the inverter 74, and as a result, a pulse $P_4$ is delivered out to serve as the channel assignment timing signal BSCH for a bass tone, via the AND gate 56 and an OR gate 76.

Furthermore, in the duet mode wherein the mode signal ABC="1" and the mode signal DUET="1", a pulse $P_1$ is delivered out to serve as the signal MLCH, as described above. And, because the AND gates 72 and 78 as well as an AND gate 80 are enabled, while the AND gates 56 and 68 are disabled by the output signal "0" of the inverter 70, a pulse $P_2$ is delivered out via the AND gate 78 to serve as the channel assignment timing signal DTCH for an add-note tone, whereas a pulse $P_3$ is delivered out through the AND gate 80 to serve as the channel assignment timing signal APCH for an arpeggio tone, and a pulse $P_4$ is delivered out through the AND gate 72 and the OR gate 76 to serve as the channel assignment timing signal BSCH for a bass tone.

The channel assignment timing signals MLCH, CDCH, BSCH, DTCH and APCH delivered out from the channel assignment controlling circuit 46 are supplied to a channel assignment circuit 82 and to a tone color data register circuit 84. Arrangement is provided so that, to the channel assignment circuit 82, are also supplied a comparison output (coincidence signal) EQ from a comparator 88 which makes comparison between the input and output data of a key data memory 86; a data category signal ML from the key coder 24; a data category signal DT from the key code forming circuit 34; a data category signal CDS from an AND gate 90; a data category signal APS from an AND gate 92; and a data category signal BS from the bass note key code forming circuit 38.

Here, the AND gate 90 is arranged so that it is enabled in accordance with the output signal "1" of an inverter 94 and also with the chord timing signal CDT when the mode is not the duet mode. Accordingly, in the mode signal FC="1", the data category signal CDS is comprised of a data category signal CD which is supplied to the AND gate via an AND gate 96 and an OR gate 98. Whereas, in case of the mode signal SF="1", it is comprised of a data category signal CS which is supplied to the AND gate 90 via an AND gate 100 and the OR gate 98. Also, the AND gate 92 is arranged to become conductive in case of the duet mode, so that the data category signal APS, then, is comprised of a data category signal AP.

The key data memory 86, as an example, like the disclosure in for example U.S. Pat. No. 4,351,214, has a data storing means comprising, for example, a shift register provided with a circulatory loop. And, this memory has first to fourth time division mutiplexed type memory channels. To this key data memory 86 are fed melody note key code data from the key coder 24, accompaniment note key code data from the key coder 24, chord-constituent note key code data from the chord-constituent note key code forming circuit 32, add-note key code data from the add-note key code forming circuit 34, bass note key code data from the bass note key code forming circuit 38 and arpeggio note key code data from the arpeggio note key code forming circuit 40. The loading of the respective key code data onto the respective memory channels (i.e. channel assignment) is controlled by a load instruction signal LD supplied from the channel assignment circuit 82.

The channel assignment circuit 82 has, as shown in the above-mentioned U.S. patent, a key-on register having first to fourth memory channels. This key-on register is so arranged that there is generated therefrom a tone generation control signal KON which is indicative of key-on ("1") or key-off ("0") for each channel timing. In case "1" is stored in all of the four channels of the key-on register, there is effected no further channel assignment since all these channels are occupied. Also, when the comparison output EQ from the comparator 88 is "1", this means that a key code data identical with the key code data which has arrived at the key data memory 86 has already been stored in the memory 86, so that no assignment of channel is carried out.

In synchronism with the loading of a key code data onto a particular memory channel of the key data memory 86, there is stored "1" in the corresponding memory channel of the key-on register, whereby the production of a corresponding musical tone becomes feasible. Also, when the comparison output EQ from the comparator 88 changes from "1" to "0" with respect to a particular memory channel, this is judged to mean that a key is released, so that the corresponding memory channel of the key-on register is cleared to "0", whereby making it possible to control the decay of the musical tone which is being sounded.

The tone color data register circuit 84 has first to fourth time division mutiplexed type memory channels as in the cases of the key data memory and said key-on register. Arrangement is made so that a tone color data for each kind of musical tone is supplied from the selected tone color detection and tone color data generation circuit 44.

In case of the normal mode, the channel assignment controlling circuit 46 delivers out sequential pulses $P_1 \sim P_4$ all to serve as channel assignment timing signals MLCH for melody tones. Accordingly, tone color data for the melody tones are loaded, at the timings of the pulses $P_1 \sim P_4$, onto the first to fourth memory channels, respectively, of the tone color data register circuit 84, and after that, they are stored in a circulatory manner.

Also, in case of the automatic bass chord mode, the channel assignment timing signal MLCH for a melody tone contains a pulse $P_1$, and accordingly, tone color data for the melody tone is loaded onto the first memory channel of the tone color data register circuit 84 in a manner similar to that of the above-mentioned normal mode. And, the manner that the tone color data are loaded on the second to fourth memory channels of the tone color data register circuit 84 would vary depending on the state of the bass timing signal BST.

More specifically, in case the bass timing signal BST is "0", the tone color data for chord tones is loaded onto the second to fourth memory channels, respectively, at timings of the pulses $P_2 \sim P_4$, respectively, which pulses being contained in the channel assignment timing signal CDCH for the chord tones. In case the bass timing signal BST is "1", the tone color data for the chord tones is loaded onto the second and third memory channels at timings of the pulses $P_2$ and $P_3$ respectively, which are contained in the channel assignment timing signal CDCH for the chord tones. Concurrently therewith, the tone color data for a bass tone is loaded onto the fourth memory channel at the timing of a pulse $P_4$ which is contained in the channel assignment timing signal BSCH for the bass tone.

Also these various kinds of tone color data which have been loaded onto the tone color data register circuit 84 as stated above are stored in this circuit 84 in a circulatory manner.

Furthermore, in case of the duet mode, the channel assignment controlling circuit 46 delivers out the pulses $P_1$, $P_2$, $P_3$ and $P_4$ to serve respectively as the channel assignment timing signal MLCH for the melody tone, the channel assignment timing signal DTCH for the add-note tone, the channel assignment timing signal APCH for the arpeggio tone, and the channel assignment timing signal BSCH for the bass tone. Accordingly, onto the first, second, third and fourth memory channels of the tone color data register 84 are respectively loaded the tone color data for the melody tone, the tone color data for the add-note tone, the tone color data for the arpeggio tone and the tone color data for the bass tone at respective timings of the pulses $P_1$, $P_2$, $P_3$ and $P_4$, and therafter they are stored there in a circulatory manner.

A tone signal generating circuit 102 generates a tone signal based on the key code data delivered out in a time division multiplexed fashion from the key data memory 86, the tone generation control signal KON delivered out in a time division multiplexed fashion from the channel assignment circuit 82, and also the tone color data delivered out in a time division mutiplexed fashion from the tone color data register circuit 84, and this circuit 102 is provided with first to fourth tone production channels. These tone production channels may be of either one of the following two types, i.e. a time division multiplexed type and a spatially discrete type. As the method for generating tone signals, there can be employed any desired one from among the waveform memory read-out method, the filter method, the frequency modulation method, arithmetic operation method and so forth.

The tone signal generating circuit 102 has four tone production channels, and accordingly it is capable of producing tone signals for four tones at the same time. The type of the tone signals which are generated, however, would vary as will be described later, depending on the normal mode, the automatic bass chord mode, and the duet mode.

The tone signals delivered out from the tone signal generating circuit 102 are applied to a loudspeaker 106 via an output amplifier 104, to be transformed into sounds.

Next, description will be made of the channel assignment and tone production operation for each of the instances of the normal mode, the automatic bass chord mode, and the duet mode. For the sake of simplicity, it is hereby assumed that the respective memory channels of the key data memory 86 and the key-on register are invariably set ready for being written in.

Normal Mode

In this mode, it should be noted that, in the keyboard circuitry 10, both the upper keyboard region and the lower keyboard region are set to function for melody playing.

Let us here assume that the key coder 24 has detected one melody key depression in either one of the upper and lower keyboard regions. Whereupon, a melody note key code data representative of this key depression is applied to the key data memory 86, and concurrently therewith, a data category signal ML="1" is fed to the channel assignment circuit 82. At such a time, sequential pulses $P_1 \sim P_4$ are being fed, as the channel assignment timing signals MLCH for the melody tones, from the channel assignment controlling circuit 46 to the channel assignment circuit 82 and to the tone color data register circuit 84.

The channel assignment circuit 82 generates a load instruction signal LD at the timing of, for example, the pulse $P_1$. In response thereto, a melody note key code data is loaded onto the first memory channel of the key data memory 86, and thereafter, the same storage is effected in a circulatory manner. Also, onto the first memory channel of the key-on register within the channel assignment circuit 82 is loaded "1" in synchronism with the data loading onto the memory 86. Thereafter, the same storage is effected in a circulatory manner.

Let us here assume that, simultaneously with the above-mentioned melody key depression, another different melody key depression is performed. In a manner similar to that described above, a melody note key code data representative of said another melody key depression is stored in the second memory channel of the key data memory 86, and "1" is stored also in the second memory channel of the key-on register.

And, in a manner similar to that just described above, it is possible to store, in the key data memory 86 and in the key-on register, those data for four keys which are depressed concurrently.

In the tone color data register circuit 84, the tone color data for the melody tones is stored in the first to fourth memory channels in accordance with the channel assignment timing signal MLCH as stated above.

Accordingly, the tone signal generating circuit 102 generates a melody tone signal based on a melody note key code data supplied from the key data memory 86, a tone generation control signal KON supplied from the key-on register, and a tone color data for the melody tones supplied from the tone color data register circuit 84. In accordance therewith, an audible melody tone in a melody tone color is delivered out from a loudspeaker 106. It should be noted here that, when the data for a plurality of keys (four keys at most) which have been depressed simultaneously have been stored in both the key data memory 86 and the key-on register, there are sounded simultaneously from the loudspeaker 106 a plurality of melody tones representative of the depressed plural keys.

Automatic Bass Chord Mode

In this instance, in the keyboard circuitry 10, the upper keyboard region is set for melody playing, and the lower keyboard region will serve for accompaniment playing.

For a melody playing in the upper keyboard region, the channel assignment controlling circuit 46 delivers out a pulse $P_1$ to serve as the channel assignment timing signal MLCH for melody note. Accordingly, it is possible to generate a melody tone by using the first memory channel of the key data memory 86 in a manner similar to that described above. It should be noted here that, in this specific mode, even when a plurality of keys are depressed simultaneously in the upper keyboard region, there is sounded only a single melody tone representative of one key among those plural keys depressed simultaneously.

On the other hand, in case an accompaniment key depression is performed in the lower keyboard region for the generation of, for example, a triad, and if the mode signal FC="1", the key coder 24 generates chord-constituent-note key code data representative of the triad depressed in the lower keyboard range and it also generates a data category signal CD="1". In case of the mode signal SF="1", the chord-constituent-note key code forming circuit 32 generates chord-constituent-note key code data corresponding to the triad designated in the lower keyboard region and it also generates a data category signal CS="1". Also, the bass note key code forming circuit 38 generates bass note key code data and a data category signal BS="1" based on the chord name data CND indicative of the abovesaid triad and also on the bass note decisive data BSP.

Let us now assume that the bass timing signal BST is "1". The channel assignment controlling circuit 46 delivers out sequential pulses $P_2$ and $P_3$ to serve as the channel assignment timing signal CDCH for the chord tones, and also delivers out a pulse $P_4$ to serve as the channel assignment timing signal BSCH for the bass tone. But at such time, the chord timing signal CDT is "0", and accordingly, the channel assignment circuit 82 does not perform channel assignment in correspondence to the timing signal CDCH, and as a result, no chord tones are sounded.

The channel assignment circuit 82 generates a load instruction signal LD at the timing of the pulse $P_4$ in accordance with the data category signal BS and with the timing signal BSCH. In accordance therewith, bass note key code data is loaded onto the fourth memory channel of the key data memory 86, and thereafter it is stored there in a circulatory manner. Also, "1" is loaded onto the fourth memory channel of the key-on register in synchronism with the loading of data onto the memory 86, and thereafter it is stored in a circulatory manner.

In the tone color data register circuit 84, a tone color data for the bass tone is stored in the fourth memory channel in accordance with the channel assignment timing signal BSCH for the bass tone, as stated above.

Accordingly, the tone signal generating circuit 102 generates a bass tone signal based on the bass note key code data supplied from the key code data memory 86, the tone generation control signal KON supplied from the key-on register, and the tone color data for the bass tone supplied from the tone color data register circuit 84. In accordance therewith, a bass tone is sounded from the loudspeaker 106. In case a melody key depression is performed in the upper keyboard region, the melody tone representative of this depressed key is delivered out also from the loudspeaker 106.

Next, let us assume that the chord timing signal CDT has become "1". Whereupon, the channel assignment controlling circuit 46 delivers out sequential pulses $P_2 \sim P_4$ to serve as the channel assignment timing signals CDCH for chord tones.

In case of the mode signal FC="1", the channel assignment circuit 82 receives a data category signal CD to serve as the data category signal CDS, and it generates a load instruction signal LD at the timings of the pulses $P_2 \sim P_4$ of the timing signal CDCH. In accordance therewith, chord-constituent-note key code data supplied from the key coder 24 are loaded onto the second to fourth memory channels of the key data memory 86, respectively, and thereafter they are stored there in a circulatory manner. Also, in synchronism with the loading onto the memory 86, "1" is loaded onto the second to fourth memory channels of the key-on register, respectively, and thereafter it is stored there in a circulatory manner.

In case of the mode signal SF="1", the channel assignment circuit 82 receives a data category signal CS to serve as the data category signal CDS, and it generates a load instruction signal LD at the timings of the pulses $P_2 \sim P_4$ of the timing signal CDCH. In accordance therewith, chord-constituent-note key code data supplied from the chord-constituent-note key code forming circuit 32 are loaded onto the second to fourth memory channels of the key data memory 86, respectively, and thereafter the storing thereof is effected in a circulatory manner. Also, "1" is stored in the second to fourth memory channels of the key-on register, respectively, in synchronism with the loading of the data onto the memory 86, in a manner similar to the instance of the mode signal FC="1" described just above.

In each case of the mode signal FC="1" and SF="1", in the tone color data register circuit 84, a tone color data for the chord tones is stored in the second to fourth memory channels, respectively, in accordance with the channel assignment timing signal CDCH for the chord tone, as stated above.

Accordingly, the tone signal generating circuit 102 generates chord tone signals based on the chord-constituent-note key code data supplied from the key data memory 86, the tone generation control signal KON supplied from the key-on register, and the tone color data for the chord tone supplied from the tone color data register circuit 84, and in accordance therewith, chord tones are sounded from the loudspeaker 106. When, at such time, a melody key depression is effected in the upper keyboard region, the melody tone representative of this depressed key is sounded from the loudspeaker 106 also.

Duet Mode

In this instance, the upper keyboard region in the keyboard circuitry 10 is set for melody playing, while the lower keyboard region is set for accompaniment playing, and a melody tone is generated by using the first memory channel of the key data memory 86, and a bass tone is generated by using the fourth memory channel of the key data memory 86, as in the case of the above-stated automatic bass chord mode. And, the features of the operation in this mode lie in that an add-note tone for the melody tone is generated, and that the chord constituent tones are sounded in the form of a broken chord, i.e. in an arpeggio style.

In case an accompaniment key depression corresponding to, for example, a triad is performed in the lower keyboard region, the arpeggio note key code forming circuit 40 delivers out successively first to third arpeggio key data corresponding to the three chord constituent notes in accordance with the arpeggio note decisive data ARP, together with their corresponding data category signals AP. At such a time, the channel assignment controlling circuit 46 delivers out a pulse $P_3$ to serve as the channel assignment timing signal APCH for the arpeggio tone.

When the channel assignment circuit 82 receives the first data category signal AP as the data category signal APS, it generates a load instruction signal LD at the timing of the pulse $P_3$. In accordance therewith, the first arpeggio note key code data is loaded onto the third memory channel of the key data memory 86, and thereafter it is stored there in a circulatory manner. Also, in synchronism with the loading onto the memory 86, "1" is loaded onto the third memory channel of the key-on register, and it is stored there in a circulatory manner. Next, as the arpeggio note key code forming circuit delivers out the second arpeggio note key code data along with the second data category signal AP, the third memory channel of the key-on register is cleared to become "0", and thereafter the second arpeggio note key code data is stored in the third memory channel of the key data memory 86 in the same way as that stated above. And, "1" is stored in the third memory channel of the key-on register. The storing operation similar to this is performed also for the third arpeggio note key code data.

In the tone color data register circuit 84, a tone color data for the arpeggio tone is stored in the third memory channel in accordance with the channel assignment timing signal APCH for the arpeggio tone, in a manner as described above.

Accordingly, the tone signal generating circuit 102 generates firstly a tone signal corresponding to the first chord constituent note based on the first arpeggio note key code data supplied from the key data memory 86, the tone generation control signal KON from the key-on register, and the tone color data for the arpeggio tone from the tone color data register circuit 84. Subsequently thereto, in the same manner, this circuit 102 generates secondly and thirdly tone signals corresponding to the second and third chord constituent notes in accordance with the second and third arpeggio note key code data. As a result, the first to third chord constituent tones are delivered out successively from the loudspeaker 106, thus making an arpeggio playing (a broken chord performance) possible. It should be noted here that the tone-producing cycles for the first to third chord constituent tones can be repeated, and also it is possible to vary their tone pitches for each cycle of tone production. In any way, the arpeggio tone production pattern is determined by the arpeggio pattern set in the automatic accompaniment pattern generator 36.

When the accompaniment key depression is being performed in the lower keyboard region in the manner as described above (accordingly, when an arpeggio playing is being done), let us assume that a key which is provided in the upper keyboard region is depressed. Whereupon, the add-note key code forming circuit 34 generates an add-note (in this example, "duet-note") key code data and a data category signal DT in accordance with the melody note key code data supplied from the upper keyboard region key register 26 and also with the chord name data CND. An actual example of the circuitry for generating a duet note based on a melody note and a chord name can be seen in U.S. patent application Ser. No. 390,952 filed June 22, 1982, and now U.S. Pat. No. 4,429,606. At such a time, the channel assignment controlling circuit 46 is delivering out a pulse $P_2$ to serve as the channel assignment timing signal DTCH for the add-note tone.

The channel assignment circuit 82 generates a load instruction signal LD at the timing of the pulse $P_2$ in accordance with the data category signal DT. In response thereto, an add-note key code data is stored in the second memory channel of the key data memory 86. In synchronism therewith, "1" is stored in the second memory channel of the key-on register.

In the tone color data register circuit 84, as stated above, there is stored an add-note tone color data in the second memory channel in accordance with the channel assignment timing signal DTCH for the add-note tone.

Accordingly, the tone signal generating circuit 102 generates an add-note tone signal based on the add-note key code data supplied from the key data memory 86, the tone generation control signal KON from the key-on register, and on the add-note tone color data from the tone color data register circuit 84. In response thereto, the add-note tone is delivered out, along with the melody note tone, from the loudspeaker 106. At such a time, it is also possible to generate the first tone of the arpeggio and/or the bass tone at the same time.

In connection with the above-mentioned embodiment, description of the present invention has been directed to the duet mode. It should be noted, however, that the present invention is not limited thereto, but also it can be applied equally effectively to the instance wherein a plurality of notes such as trio playing are intended to be added, although the number of the tone production channels should be increased accordingly.

As discussed above, according to the present invention, in such an add-note mode as duet playing, an arrangement is provided so that a plurality of tones which are normally to be sounded simultaneously as a chord are produced successively as a broken chord, and that one of the tone production channels for said plurality of tones is used for the purpose of generating the add-note tone. Therefore, there is eliminated the need to provide a further special tone production channel exclusively for the add-note tone, thus providing the advantage that the number of the channels can be kept unincreased. Also, because of this limited number of channels, it is possible to lower the frequency of the clock pulse signal which is used for the channel assignment or the production of tones, and hence there is a further advantage that the designing of circuits becomes easy. Moreover, since plural notes are changed from simultaneous sounding to successive sounding, there is another advantage that such add-note tones as in the case of duet performance can be recognized clearly and distinctively.

What is claimed is:

1. An electronic musical instrument, comprising:

keyboard means having keys representing respective notes and being capable of being depressed;

key data generating means for generating a plurality of key data representing, respectively, a plurality of tones to be sounded based on depression of the keys in said keyboard means;

tone production means having a plurality of tone production channels each for producing a tone as designated by any one of said key data; and channel assignment means for respectively assigning a plurality of said key data supplied from said key data generating means to said plurality of tone production channels of said tone production means each to designate a tone to be produced therefrom; the improvement wherein said key data generating means comprises:

first key data generating means for generating a plurality of key data representative, respectively, of the plurality of tones which are to be sounded simultaneously as a chord based on the key depression of the key or keys in said keyboard means;

second key data generating means for successively generating a plurality of key data representative, respectively, of the plurality of tones which are to be sounded in succession as a broken chord based on the depression of the keys in said keyboard means; and third key data generating means for generating a key data representative of a tone different from said plurality of tones which are to be sounded simultaneously based on the depression of the keys in said keyboard means, said electronic musical instrument further comprising:

controlling means for supplying a controlling signal to said channel assignment means to thereby cause this latter means to selectively perform either one of a first operation of respectively assigning the plurality of key data from said first key data generating means to said plurality of tone production channels, and a second operation of respectively assigning the key data from said second key data generating means and the key data from said third key data generating means to at least two among said plurality of tone production channels.

2. An electronic musical instrument according to claim 1, wherein:

said first key data generating means forms a plurality of key codes representative of chord constituent notes to be sounded simultaneously;

said second key data generating means forms arpeggio note key codes representative of the chord constituent notes to be sounded in succession; and said third key code data generating means forms a key code representative of an add-note tone different from said chord constituent notes.

* * * * *